United States Patent [19]

Grosch

[11] 4,241,789

[45] Dec. 30, 1980

[54] CONCRETE WALL CASING WITH CENTRALIZERS EMBEDDED THEREIN

[76] Inventor: Gottlieb W. Grosch, Silver Creek, Nebr. 68663

[21] Appl. No.: 905,193

[22] Filed: May 12, 1978

[51] Int. Cl.[3] ..... E21B 17/00

[52] U.S. Cl. ..... 166/241; 166/242; 138/175; 52/125

[58] Field of Search ..... 166/241, 242; 138/175; 52/125; 405/43

[56] References Cited

U.S. PATENT DOCUMENTS

| | | | |
|---|---|---|---|
| 1,466,986 | 9/1923 | Burgher | 166/241 |
| 3,095,041 | 6/1963 | Rasmussen | 166/242 |
| 3,128,827 | 4/1964 | Kluck | 166/241 |
| 3,240,274 | 3/1966 | Solum | 166/241 |
| 3,420,309 | 1/1969 | Beylik | 166/242 |
| 4,011,907 | 3/1977 | Clay | 166/241 |
| 4,070,832 | 1/1978 | Grosch | 52/125 |

*Primary Examiner*—William F. Pate, III

*Attorney, Agent, or Firm*—Zarley, McKee, Thomte, Voorhees & Sease

[57] ABSTRACT

A concrete well casing comprising a cylindrical reinforcing mesh wire having inner and outer sides and upper and lower ends. A plurality of flat centralizers have their lower ends secured to the wire mesh in a spaced-apart condition adjacent the lower end thereof and extend outwardly and upwardly therefrom. The wire mesh is embedded in concrete to form a casing. Each of the centralizers has an outer end portion which is normally substantially flush with the exterior surface of the casing but which may be deflected or bent outwardly therefrom for engagement with the wall surface of a well bore hole to centralize the casing with respect to the well bore hole as it is being lowered thereinto.

3 Claims, 5 Drawing Figures

CONCRETE WALL CASING WITH CENTRALIZERS EMBEDDED THEREIN

BACKGROUND OF THE INVENTION

This invention relates to a concrete well casing and more particularly to a concrete well casing having centralizers secured thereto which center or centralize the well casing within a well bore hole.

Concrete well casing is ordinarily positioned in a well to prevent the walls of the well from collapsing. The concrete well casings normally are comprised of a cylindrical wire mesh which is embedded in concrete. A predetermined portion of the well casing string is perforated to permit water to enter the interior of the casing.

The customary manner of positioning the casing members in a well is to lower the same by means of casing cables. Applicant has been previously granted U.S. Pat. No. 4,070,832 which provided a concrete well casing with cable hooks embedded therein to facilitate the lowering of the casing into the well. A problem still exists in the positioning of the casing members within the bore hole when the diameter of the bore hole is greater than the outside diameter of the casing member. The customary practice at present is to secure a plurality of boards such as 2×4's to the exterior surface of certain of the casing members so that the boards will engage the wall surface of the bore hole to centralize or center the casing with respect to the well bore hole. The necessity of securing boards to the casing is not only time consuming but is quite expensive. A further problem with the use of boards is that the width of the boards combined with the diameter of the casing is either too great or too small for the particular bore hole.

Therefore, it is a principal object of the invention to provide a concrete well casing having centralizers secured thereto and integrally formed therewith.

A still further object of the invention is to provide a concrete well casing having centralizers secured thereto which may be selectively adjusted to correspond to the diameter of the bore hole.

A still further object of the invention is to provide a concrete well casing having centralizers secured thereto which do not interfere with the fabrication of the casing.

A still further object of the invention is to provide a concrete well casing having centralizers mounted thereon which is economical of manufacture and durable in use.

These and other objects will be apparent to those skilled in the art.

SUMMARY OF THE INVENTION

Figure 1:
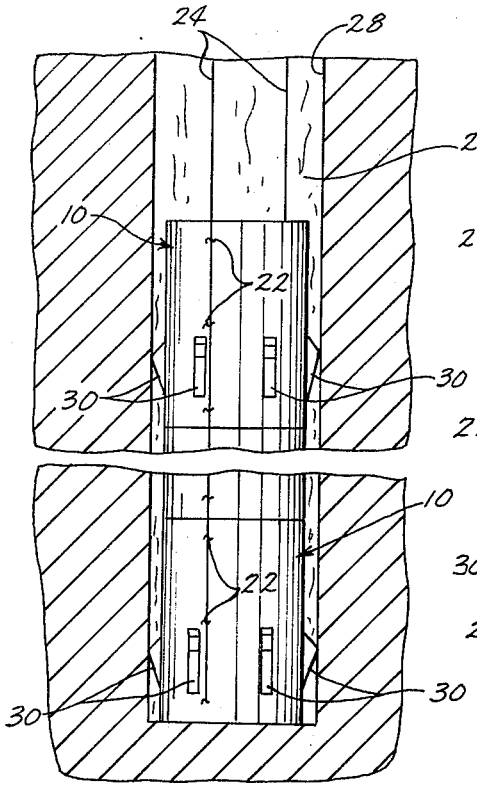
FIG. 1 is a partial sectional view illustrating the concrete well casing of this invention positioned in a well.
Figure 2:
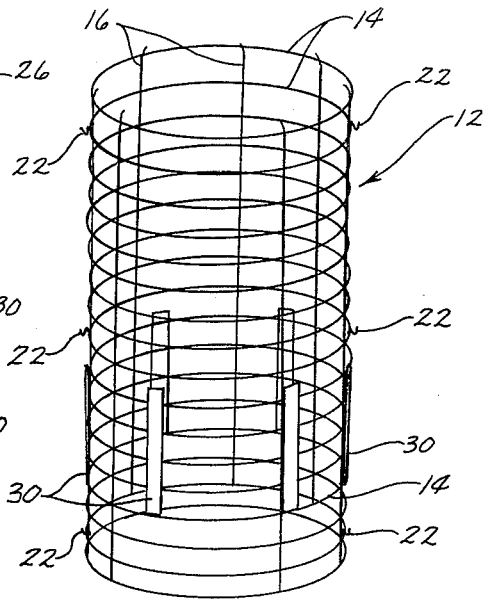
FIG. 2 is a perspective view of the reinforcing wire and centralizers secured thereto prior to the concrete being placed thereon.

A concrete well casing is described including a reinforcing wire mesh embedded within concrete. A plurality of elongated flat centralizers are secured to the wire mesh adjacent the lower end thereof in a spaced-apart relationship. The centralizers have their lower ends secured to the wire mesh and extend upwardly and outwardly therefrom. The major portion of the centralizer is initially substantially flush with the exterior surface of the concrete casing but may be bent outwardly therefrom for engagement with the wall surface of the well bore hole to centralize or center the casing with respect to the bore hole. The upper end of the centralizer is bent inwardly so that the upper end engages the exterior surface of the casing to prevent the centralizer from being bent inwardly from the desired position during the lowering of the casing into the well.

DESCRIPTION OF THE PREFERRED EMBODIMENT

The concrete well casing of this invention is referred to generally by the reference numeral 10. Casing 10 would normally include a cylindrical wire mesh or reinforcing wire 12 which is comprised of a plurality of horizontally disposed and vertically spaced ring-shaped members 14 operatively interconnected by a plurality of vertically extending rods 16 secured thereto by welding or the like. Ordinarily, the wire mesh 12 is embedded in a layer of concrete in conventional fashion and which is referred to generally by the reference numeral 18. While it is preferred that the casing include the reinforcing wire, it is possible to form the casing without the same. The casing 18 may or may not be provided with a plurality of perforations formed therein to permit the water in the water bearing sand to enter the interior of the casing members when the same are positioned within the well. The casing disclosed herein does not illustrate the conventional perforations such as illustrated in U.S. Pat. No. 4,070,832 but it should be understood that the perforations could be employed if so desired.

The numeral 22 refers to cable hooks secured to the wire mesh. The cable hooks are fully described in U.S. Pat. No. 4,070,832. The cable hooks illustrated herein may or may not be used with the embodiment of this invention although it is preferred that they be used in conjunction with the cables 24 for lowering the casings into the well 26 having a wall surface 28.

A plurality of elongated flat members or centralizers 30 are preferably secured to the wire mesh 12 in a radially spaced-apart condition. The lower ends of each of the centralizers 30 are secured to the wire mesh by welding or the like. Although it is preferred that the centralizers be secured to the wire mesh, it is possible to embed the lower ends of the centralizers within the concrete of the casing in such a manner so as to effectuate a rigid attachment thereto without the use of the wire mesh connection.

Figure 3:
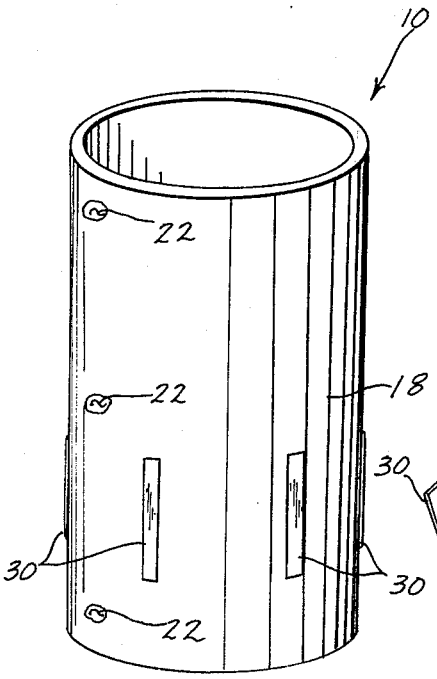
FIG. 3 is a perspective view of the casing prior to the centralizers being bent outwardly therefrom.
Figure 4:
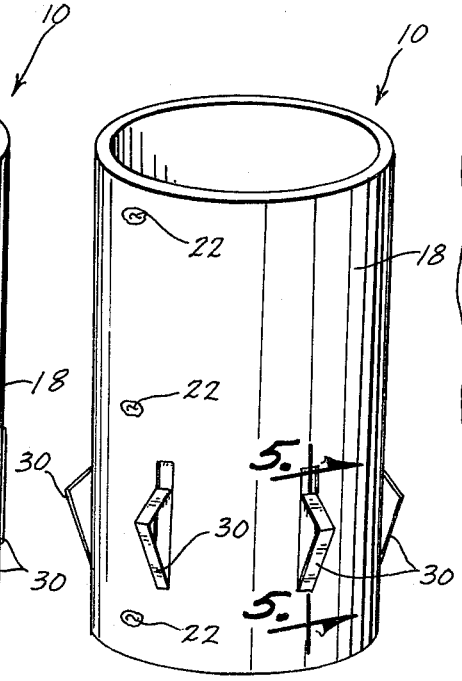
FIG. 4 is a perspective view similar to FIG. 3 except that the centralizers have been bent outwardly therefrom with the dotted lines indicating alternate positions of the centralizers.
Figure 5:
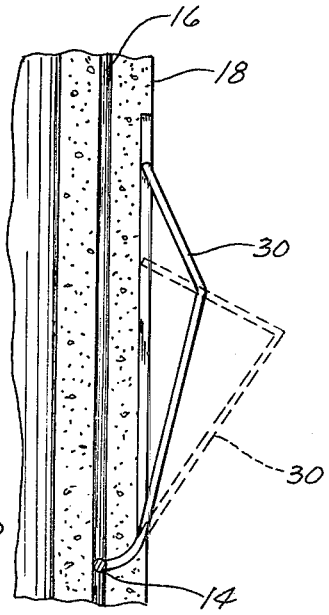
FIG. 5 is a close-up sectional view of the casing with the centralizer along the section line shown in FIG. 4.

Each of the centralizers 30 has a lower end portion which is secured to the wire mesh as previously described adjacent the lower end thereof. The centralizer extends upwardly and outwardly from its lower end so that a majority of the length thereof will be positioned substantially flush with the exterior surface of the casing after the concrete has been placed on the mesh to form the casing as illustrated in FIG. 3. The concrete is placed on the wire mesh in conventional fashion. When the casing 18 is to be lowered into the well 26, the centralizers 30 are deflected or bent outwardly from the exterior surface of the casing 18 as illustrated in the drawings. The diameter of the well and the diameter of the casing will dictate the final configuration of the centralizers 30. The centralizer 30 is bent as illustrated in the drawings so that the upper end portion thereof extends upwardly and inwardly for engagement with the exterior surface of the casing 18. The engagement of the upper end of the centralizer 30 with the exterior surface of the casing 18 maintains the centralizer 30 in position and prevents it from being inadvertently "flattened" during the lowering of the casing into the well. If a larger diameter well hole is being employed than that illustrated, the centralizers 30 are bent into a different shape such as that illustrated by broken lines in FIG. 5. Thus, the centralizers 30 may be selectively bent so that the casing will be centralized with respect to the well regardless of the diameter of the well.

The casing is secured to the casing cables by means of the cable hooks 22 and is lowered into the well in conventional fashion. The centralizers 30 engage the wall surface of the bore hole or well as the casing is being lowered so that the casing is maintained in the center of the well which is very important in well drilling and completion operations.

It is not necessary that each of the casings within the well have the centralizers provided thereon but it is preferred that a casing having the centralizers 30 thereon be employed every three to five casings.

Thus it can be seen that a novel means has been provided for centralizing a well casing within a well which eliminates the time consuming task of securing boards or the like thereto. It can also be seen that the centralizers do not interfere with the fabrication of the casing and may be easily bent outwardly from the casing into various configurations to accommodate various well diameters. Therefore, it can be seen that the invention accomplishes at least all of its stated objectives.

I claim:

1. A concrete well casing, comprising, a hollow cylindrical concrete casing member having upper and lower ends, inner and outer wall surfaces, a plurality of elongated casing centralizers each having one end embedded in said concrete casing member, said centralizers being spaced around the circumference of said casing member and extending outwardly from said outer wall surface for engagement with the wall surface of the well to centralize the casing as it is lowered into the well, said centralizers being initially substantially flush with the outer wall surface of said casing member but which may be deflected outwardly therefrom for engagement with the wall surface of the well bore hole to centralize said casing member with respect to said well bore hole, each of said centralizers comprising elongated flat members having upper and lower ends, the lower end of said flat member being embedded within said casing member, said centralizer extending upwardly and outwardly with respect to the outer surface of said casing member, thence inwardly towards said casing member so that the upper end of said flat member engages the exterior surface of said casing member when said flat member has been deflected outwardly from said casing member.

2. The structure of claim 1 wherein the longitudinal axis of each of said elongated flat members is initially substantially parallel to the longitudinal axis of the casing member.

3. The structure of claim 1 wherein said centralizers are positioned adjacent the lower end of said casing member.

* * * * *